US011482200B2

(12) United States Patent
Ruff

(10) Patent No.: US 11,482,200 B2
(45) Date of Patent: Oct. 25, 2022

(54) BANJO ACOUSTIC-CHAMBER CUSHION

(71) Applicant: Jeffrey Ruff, Toluca Lake, CA (US)

(72) Inventor: Jeffrey Ruff, Toluca Lake, CA (US)

(73) Assignee: WINDSOR BANJO COMPANY LLC, Toluca Lake, CA (US)

( * ) Notice: Subject to any disclaimer, the term of this patent is extended or adjusted under 35 U.S.C. 154(b) by 0 days.

(21) Appl. No.: 17/398,990

(22) Filed: Aug. 10, 2021

(65) Prior Publication Data

US 2022/0044658 A1 Feb. 10, 2022

Related U.S. Application Data

(60) Provisional application No. 63/063,721, filed on Aug. 10, 2020.

(51) Int. Cl.
*G10D 3/18* (2020.01)
*G10D 1/10* (2006.01)

(52) U.S. Cl.
CPC ..... *G10D 3/18* (2013.01); *G10D 1/10* (2013.01)

(58) Field of Classification Search
CPC .. G10D 3/18; G10D 1/10; G10D 3/00; G10D 1/00
See application file for complete search history.

(56) References Cited

U.S. PATENT DOCUMENTS 885,269 A * 4/1908 Mathey ..... G10D 1/10 84/269

* cited by examiner

*Primary Examiner* — Kimberly R Lockett

(57) ABSTRACT

A banjo acoustic-chamber cushion is an apparatus that is used to minimize the discomfort caused by the sharp edges and brackets found around the perimeter of the acoustic chamber of a banjo. The apparatus may include a circular padded backing and an annular padded rim. The circular padded backing serves as a shield between the player's body and the back of a banjo acoustic chamber without obstructing the playing of the banjo. The circular padded backing also protects the back of the banjo acoustic chamber from physical damage such as scratches or dents. The annular padded rim serves as a shield between the player's body and the rim of the banjo acoustic chamber. The annular padded rim also secures the apparatus to the banjo acoustic chamber. Further, the annular padded rim protects the outer lateral surfaces of the banjo acoustic chamber from physical damage such as scratches and dents.

20 Claims, 7 Drawing Sheets

BANJO ACOUSTIC-CHAMBER CUSHION

The current application claims a priority to the U.S. provisional patent application Ser. No. 63/063,721 filed on Aug. 10, 2020.

FIELD OF THE INVENTION

The present invention generally relates to musical instruments and accessories. More specifically, the present invention is a covered cushion that wraps around a banjo acoustic chamber to minimize the discomfort experienced by the user when playing the banjo while sitting.

BACKGROUND OF THE INVENTION

Banjos are a traditional musical instrument often heard in folk music and other music genres as well. While banjos are generally designed to be played without any special support, apart from a shoulder strap, most banjos can often cause discomfort to the players due to the structure of the banjo acoustic chamber. In general, the sharp outer edges of the acoustic chamber and the multiple brackets around the acoustic chamber can dig into the player's legs, which often cause discomfort and can even hurt the player's legs after long periods of playtime. There are various padding accessories available that can be used to alleviate this issue. However, most of these options do not provide full protection as they only partially cover the banjo acoustic chamber. Other options such as covers do protect the acoustic chamber but provide little cushioning to protect the player's legs.

An objective of the present invention is to provide a banjo acoustic-chamber cushion that covers the back and the lateral side of the banjo acoustic chamber to protect the player's legs from the sharp edges or the brackets often found around the perimeter of the banjo acoustic chamber. Another objective of the present invention is to provide a banjo acoustic-chamber cushion that conforms to the structure of the banjo acoustic chamber without impeding the playing of the banjo. Another objective of the present invention is to provide a banjo acoustic-chamber cushion that is easy to attach and remove and provides storage for various items such as sheet music, plectrums, etc. Additional features and benefits of the present invention are further discussed in the sections below.

SUMMARY OF THE INVENTION

The present invention is a banjo acoustic-chamber cushion that relieves the physical pain associated with playing the banjo in a seated position. The banjo acoustic-chamber cushion is a covered padding structure that wraps around the circular shape of the banjo acoustic chamber to shield the player's body from the sharp edges of the banjo acoustic chamber and its fasteners. The banjo acoustic-chamber cushion is preferably a foam cushioning covered in cloth or vinyl with a circular design of roughly the same dimensions of a banjo acoustic chamber. The banjo acoustic-chamber cushion also increases the attention span and comfort of the banjoist which results in longer performances, longer time and increased productivity in the studio when working for hire, and longer time in the studio to make recordings for sale; a happier disposition resulting in more gigs in general.

DETAILED DESCRIPTION OF THE INVENTION

All illustrations of the drawings are for the purpose of describing selected versions of the present invention and are not intended to limit the scope of the present invention.

Figure 1:
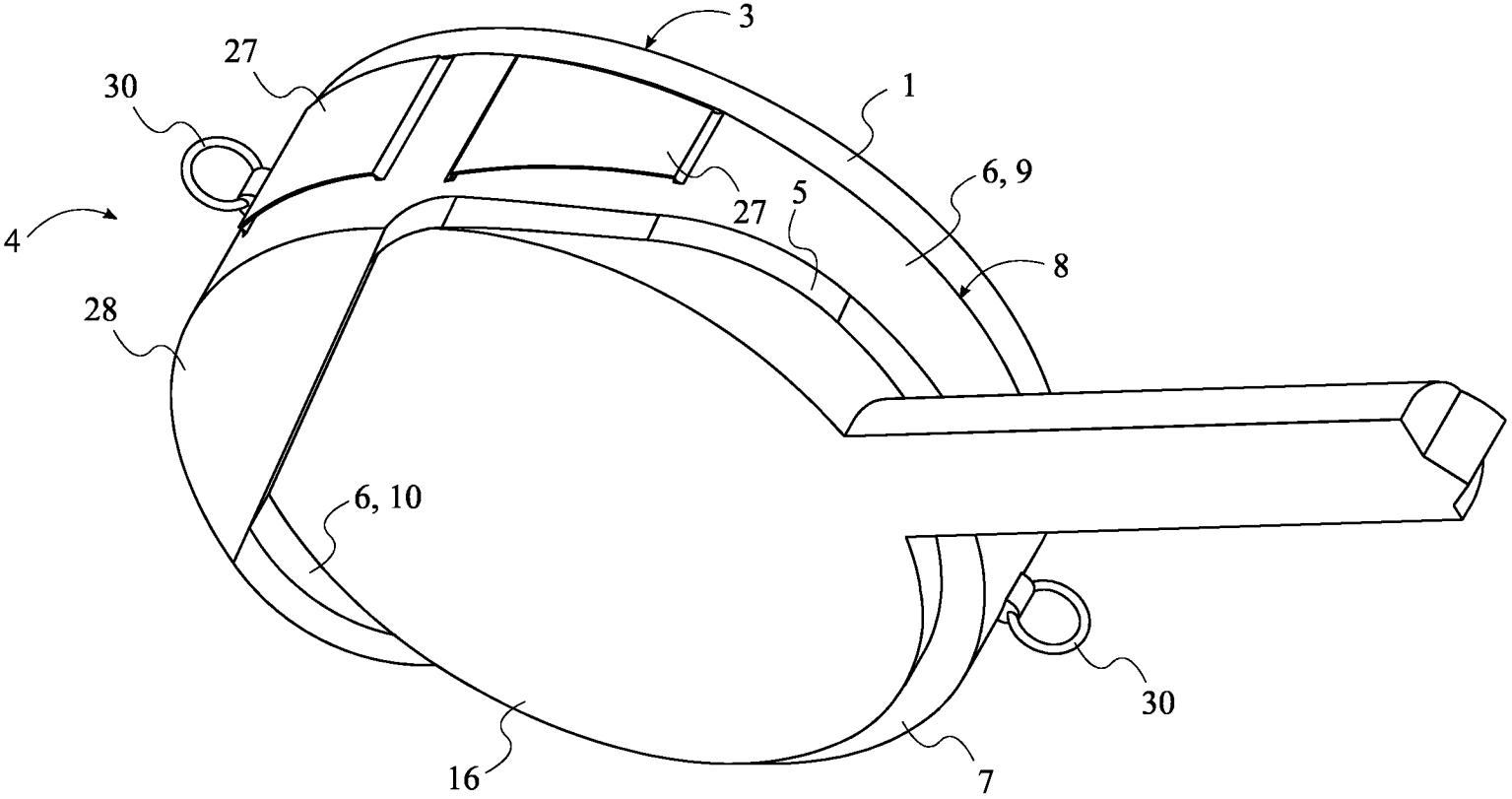
FIG. 1 is a top front perspective view of the present invention, wherein the present invention is shown attached to a banjo acoustic chamber.
Figure 3:
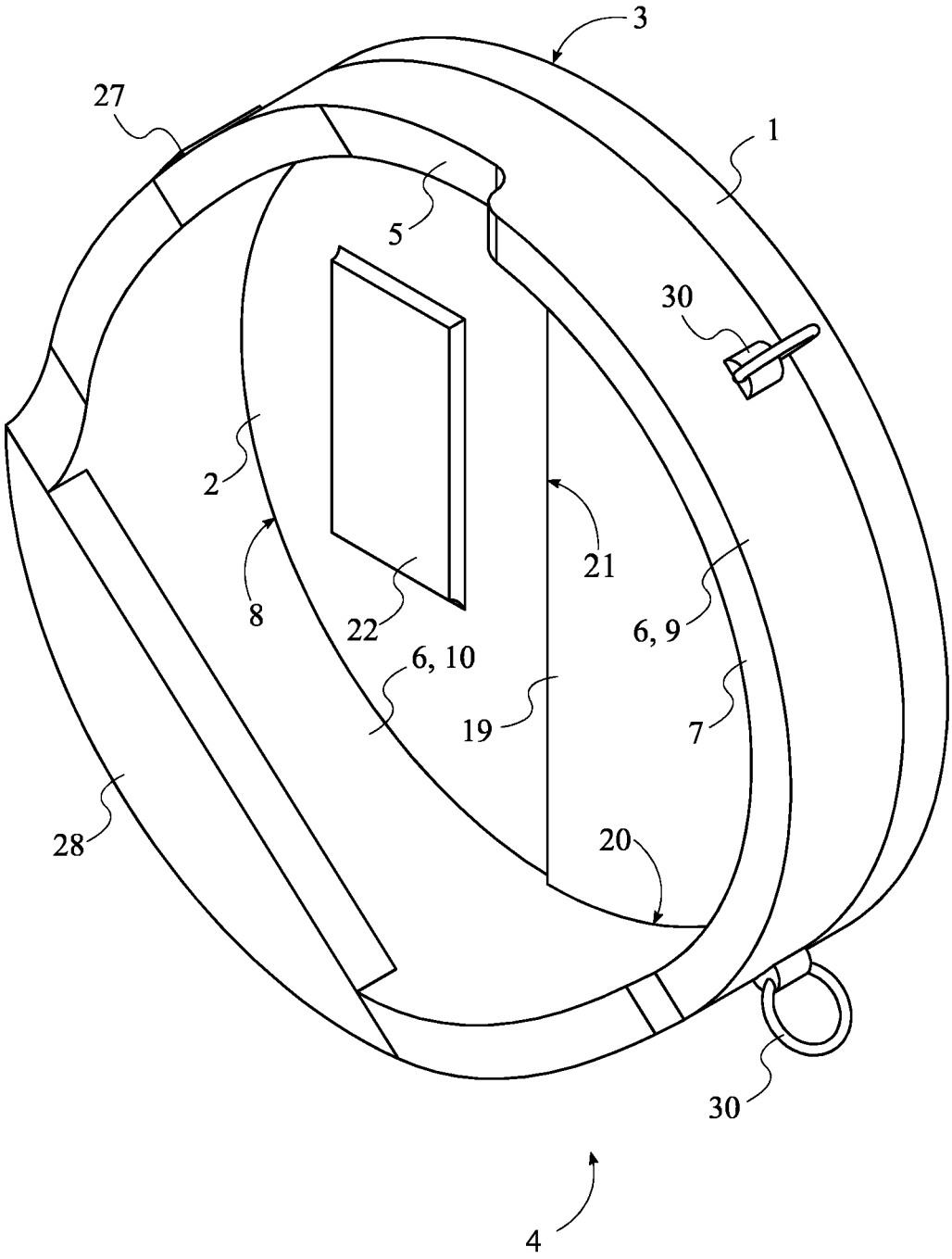
FIG. 3 is a bottom front perspective view of the present invention.

The present invention is a banjo acoustic-chamber cushion that minimizes the discomfort caused by the sharp edges and brackets found around the perimeter of the acoustic chamber of a banjo. As can be seen in FIGS. 1 and 3, the present invention may comprise a circular padded backing 1 and an annular padded rim 4. The circular padded backing 1 serves as a shield between the player's body and the back of a banjo acoustic chamber 16. The circular padded backing 1 also protects the back of the banjo acoustic chamber 16 from physical damage such as scratches or dents. The annular padded rim 4 serves as a shield between the player's body and the rim of the banjo acoustic chamber 16. The annular padded rim 4 also serves to secure the present invention to the banjo acoustic chamber 16. Further, the annular padded rim 4 protects the outer lateral surfaces of the banjo acoustic chamber 16 from physical damage.

The general configuration of the aforementioned components enables players to comfortably play a banjo for prolonged periods without experiencing major discomfort. As can be seen in FIGS. 1 through 4, the circular padded backing 1 is designed to fit the banjo acoustic chamber 16 in banjos with a resonator or without a resonator. So, the circular padded backing 1 preferably has a thick disk-shaped design to fit the back of the banjo acoustic chamber 16. The circular padded backing 1 comprises a distal backing face 2 and a proximal backing face 3 due to the disk shape of the circular padded backing 1. On the other hand, the annular padded rim 4 is designed to fit around the flange/rim portion of the banjo acoustic chamber 16. So, the annular padded rim 4 is preferably a ring-like structure that fits around the banjo acoustic chamber 16. The annular padded rim 4 comprises a neck-receiving cutout 5 and a rim body 6. The rim body 6 preferably corresponds to the ring-like structure of the annular padded rim 4 while the neck-receiving cutout 5 corresponds to the opening designed to accommodate the banjo's neck. Moreover, the rim body 6 comprises a distal rim face 7, a proximal rim face 8, an outer annular surface 9, and an inner annular surface 10. The distal rim face 7 and the proximal rim face 8 preferably correspond to the base surfaces of the rim body 6. The outer annular surface 9 and the inner annular surface 10 preferably correspond to the cylindrical surfaces of the rim body 6. Further, a 0-degree axis 11, a 90-degree axis 12, a 180-degree axis 13, and a 270-degree axis 14 are radially positioned to the annular padded rim 4 to orient the rest of the components. In other embodiments, different coordinate systems can be used to orient the different components of the present invention.

The circular padded backing 1 and the annular padded rim 4 preferably form a single, cylindrical padding structure that wraps around the banjo acoustic chamber 16. As can be seen in FIGS. 1 through 5, the annular padded rim 4 is positioned concentric to the circular padded backing 1 to form a short cylindrical structure. The proximal rim face 8 is connected onto the distal backing face 2 to connect the annular padded rim 4 to the circular padded backing 1. The neck-receiving cutout 5 traverses into the rim body 6 from the distal rim face 7 to form a large opening to receive the banjo acoustic chamber 16. The neck-receiving cutout 5 also traverses through the rim body 6 from the outer annular surface 9 to the inner annular surface 10 to accommodate the protruding banjo's neck. Further, a diameter 15 of the inner annular surface 10 is sized to compressively fit around the banjo acoustic chamber 16. Thus, the present invention snuggly fits around the banjo acoustic chamber 16 so that the present invention does not come loose while the banjo is being played.

Figure 4:
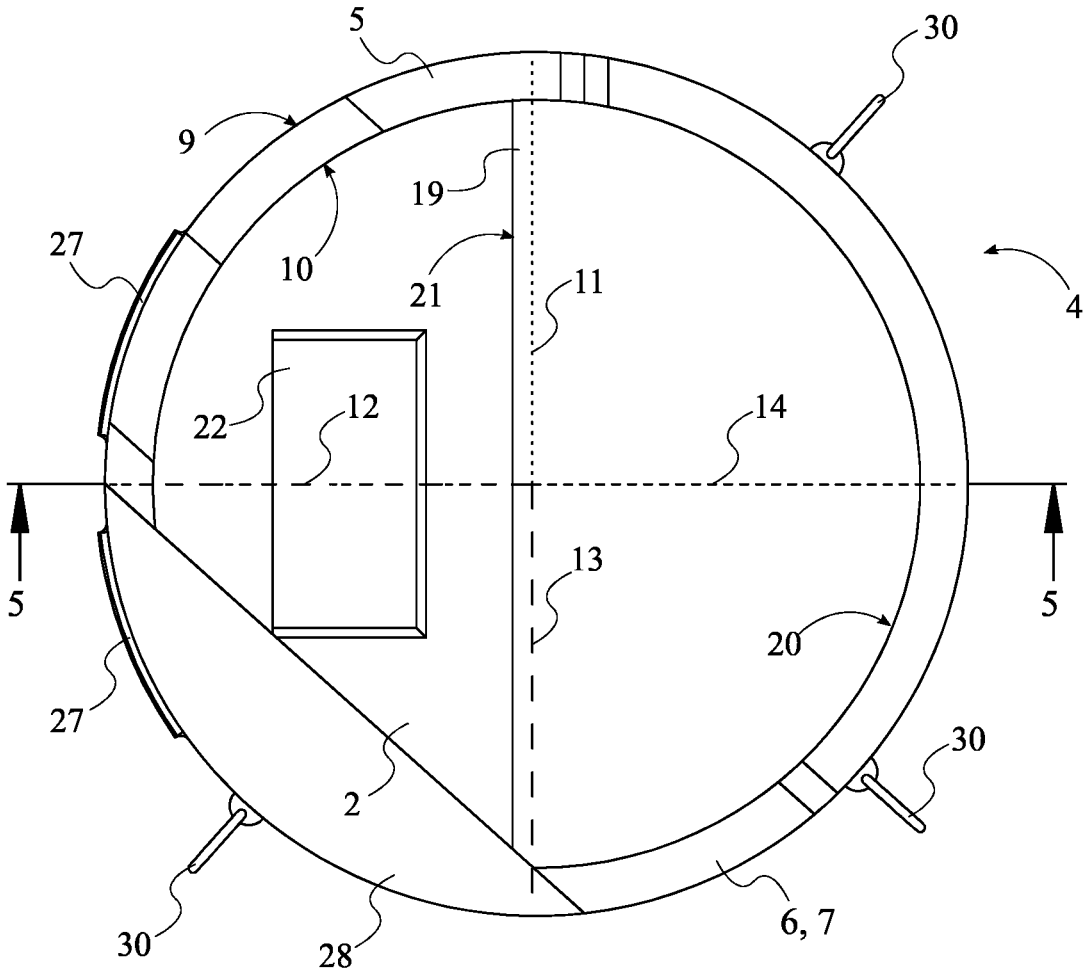
FIG. 4 is a front view of the present invention.
Figure 5:
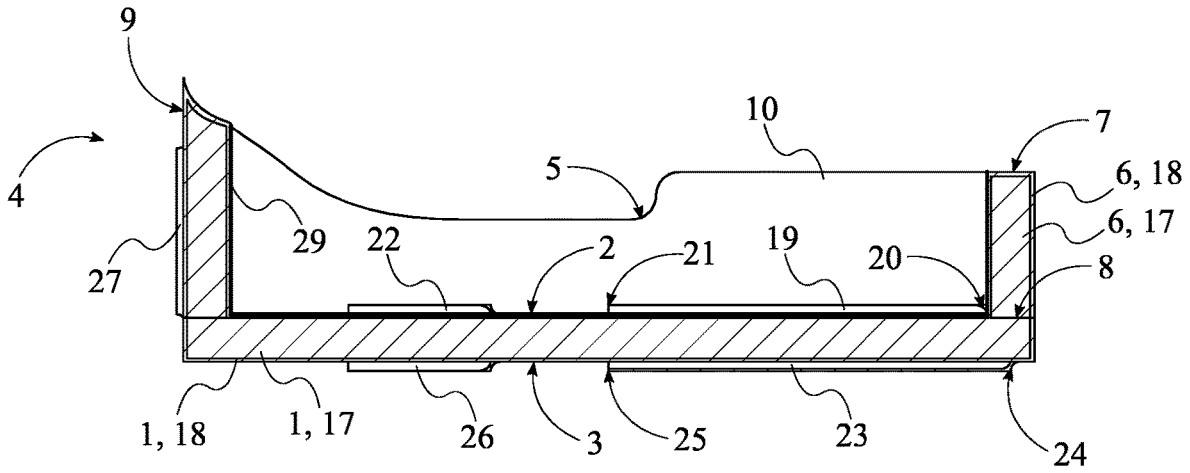
FIG. 5 is a cross-sectional view taken along line 5-5 in FIG. 4.

As previously discussed, the circular padded backing 1 and the annular padded rim 4 form a single padding structure. As can be seen in FIGS. 4 and 5, the circular padded backing 1 and the annular padded rim 4 are preferably made of a shared cushioning material 17 and a shared covering material 18. In addition, the shared cushioning material 17 is enclosed by the shared covering material 18. This allows for the shared cushioning material 17 to be protected from damage or wear out by the shared covering material 18. Further, the shared cushioning material 17 is preferably a durable, soft material that does not easily deform due to constant use. So, the shared cushioning material 17 is selected from a group consisting of a polyurethane foam and a cellulose-based material. Similarly, the shared covering material 18 is a durable but soft material that does not hurt the player's arm while playing the banjo. So, the shared covering material 18 is selected from a group consisting of vinyl and nylon. In other embodiments, the shared cushioning material 17 and/or the shared covering material 18 can be made of different cushioning and/or covering materials.

In addition to the cushioning capabilities of the present invention, the present invention can further provide means to store different tools or materials needed by the player. So, the present invention may further comprise at least one primary distal pocket 19 designed to store sheet music or other large objects. As can be seen in FIGS. 1 through 4, the at least one primary distal pocket 19 is mounted onto the distal backing face 2 so that the at least one primary distal pocket 19 is hidden when the present invention is attached to the banjo acoustic chamber 16 but accessible when the present invention is removed from the banjo acoustic chamber 16. Further, the at least one primary distal pocket 19 is designed to match the inner design of the distal backing face 2. So, the at least one primary distal pocket 19 may comprise a primary distal concave edge 20 and a primary distal straight edge 21. The primary distal concave edge 20 corresponds to the edge that conforms to the shape of the inner annular surface 10 while the primary distal straight edge 21 corresponds to the edge where the opening of the at least one primary distal pocket 19 is located. The primary distal concave edge 20 is peripherally connected about the distal backing face 2 to secure the at least one primary distal pocket 19 to the distal backing face 2. The primary distal concave edge 20 further intersects the 0-degree axis 11, the 270-degree axis 14, and the 180-degree axis 13. This positions the primary distal straight edge 21 facing the player before the present invention is attached to the banjo acoustic chamber 16. Furthermore, to prevent the at least one primary distal pocket 19 from obstructing the banjo acoustic chamber 16 when the present invention is attached to the banjo, the at least one primary distal pocket 19 is made of an elastic fabric material. This enables the at least one primary distal pocket 19 to take the least space when empty while also enabling multiple objects to be inserted into the at least one primary distal pocket 19 by stretching the elastic fabric material.

In some embodiments, the present invention may further comprise at least one secondary distal pocket 22 in addition to the at least one primary distal pocket 19. As can be seen in FIGS. 3 and 4, the at least one secondary distal pocket 22 is preferably designed to retain smaller objects such as a plectrum. Like the at least one primary distal pocket 19, the at least one secondary distal pocket 22 is mounted onto the distal backing face 2. In addition, the at least one secondary distal pocket 22 is positioned offset from the at least one primary distal pocket 19 to not block the opening of the at least one primary distal pocket 19. Further, like the at least one primary distal pocket 19, the at least one secondary distal pocket 22 is made of an elastic fabric material that stretches to receive the object. In other embodiments, the present invention may include additional storage compartments inside the annular padded rim 4.

Figure 6:
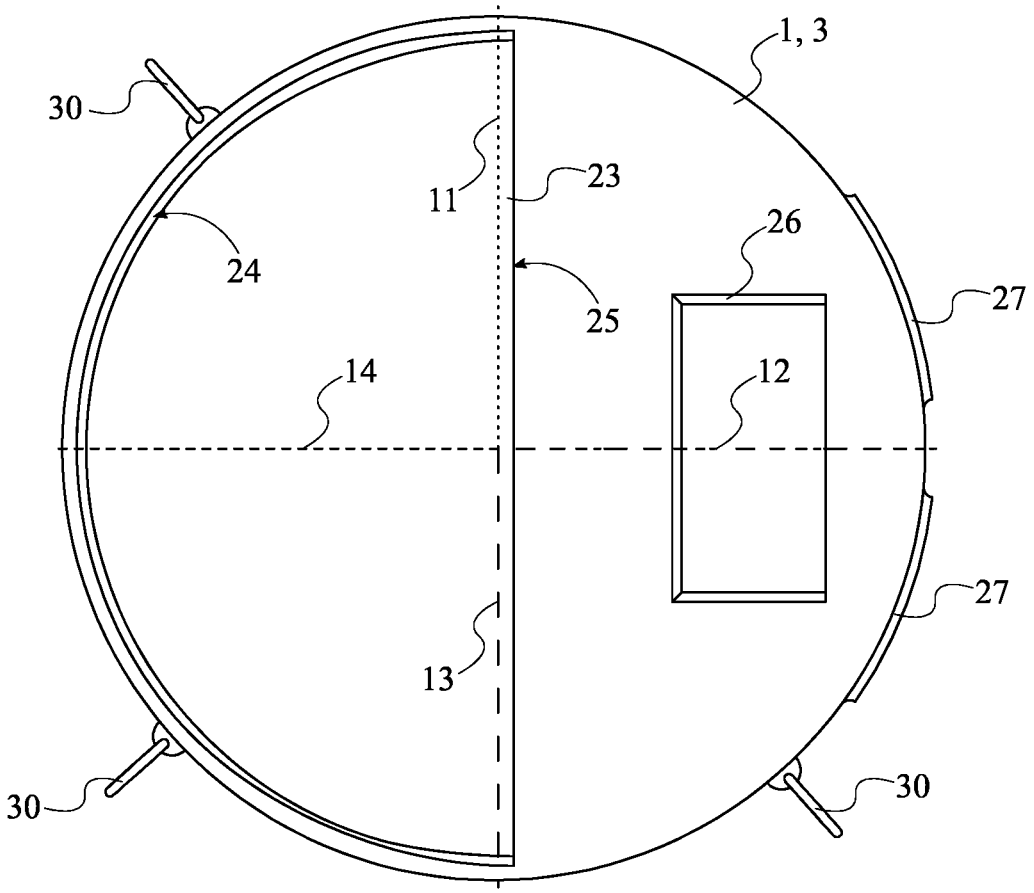
FIG. 6 is a back view of the present invention.
Figure 7:
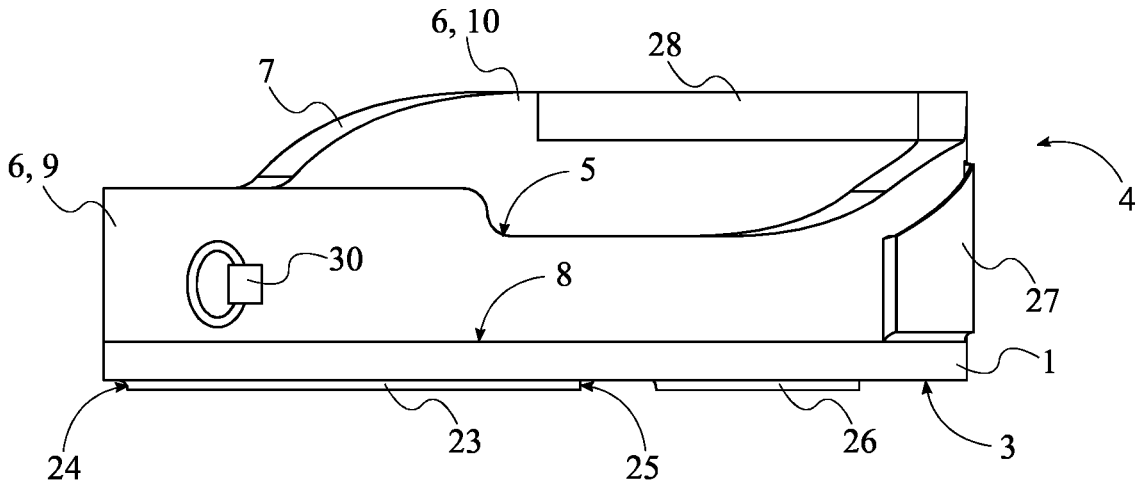
FIG. 7 is a side view of the present invention.

The present invention may further include external storage compartments to keep objects accessible from the outside of the present invention. As can be seen in FIGS. 5 through 7, the present invention may further comprise at least one primary proximal pocket 23 designed to store additional sheet music or other large objects. The at least one primary proximal pocket 23 is mounted onto the proximal backing face 3. This enables the at least one primary proximal pocket 23 to be always accessible even when the present invention is attached to the banjo acoustic chamber 16. Further, the at least one primary proximal pocket 23 is designed to match the outer design of the proximal backing face 3. So, the at least one primary proximal pocket 23 may comprise a primary proximal concave edge 24 and a primary proximal straight edge 25. The primary proximal concave edge 24 corresponds to the edge that conforms to the shape of the outer annular surface 9 while the primary proximal straight edge 25 corresponds to the edge where the opening of the at least one primary proximal pocket 23 is located. The primary proximal concave edge 24 is peripherally connected about the proximal backing face 3 to secure the at least one primary proximal pocket 23 to the proximal backing face 3. The primary proximal concave edge 24 further intersects the 0-degree axis 11, the 270-degree axis 14, and the 180-degree axis 13. This positions the primary proximal straight edge 25 facing the player when the present invention is attached to the banjo acoustic chamber 16. Furthermore, the at least one primary proximal pocket 23 is made of an elastic fabric material that stretches to receive the desired objects to be stored. This enables the at least one primary proximal pocket 23 to take the least space when empty while also enabling multiple objects to be inserted into the at least one primary proximal pocket 23 by stretching the elastic fabric material.

Like the at least one secondary distal pocket 22, the present invention may further comprise at least one secondary proximal pocket 26 on the proximal backing face 3 to retain small objects on the outside of the present invention. As can be seen in FIGS. 5 through 7, the at least one secondary proximal pocket 26 is preferably designed to retain smaller objects such as a plectrum. Like the at least one primary proximal pocket 23, the at least one secondary proximal pocket 26 is mounted onto the proximal backing face 3. In addition, the at least one secondary proximal pocket 26 is positioned offset from the at least one primary proximal pocket 23 to not block the opening of the at least one primary proximal pocket 23. Further, like the at least one primary proximal pocket 23, the at least one secondary proximal pocket 26 is made of an elastic fabric material. In other embodiments, the present invention may include additional storage compartments outside the annular padded rim 4.

Figure 2:
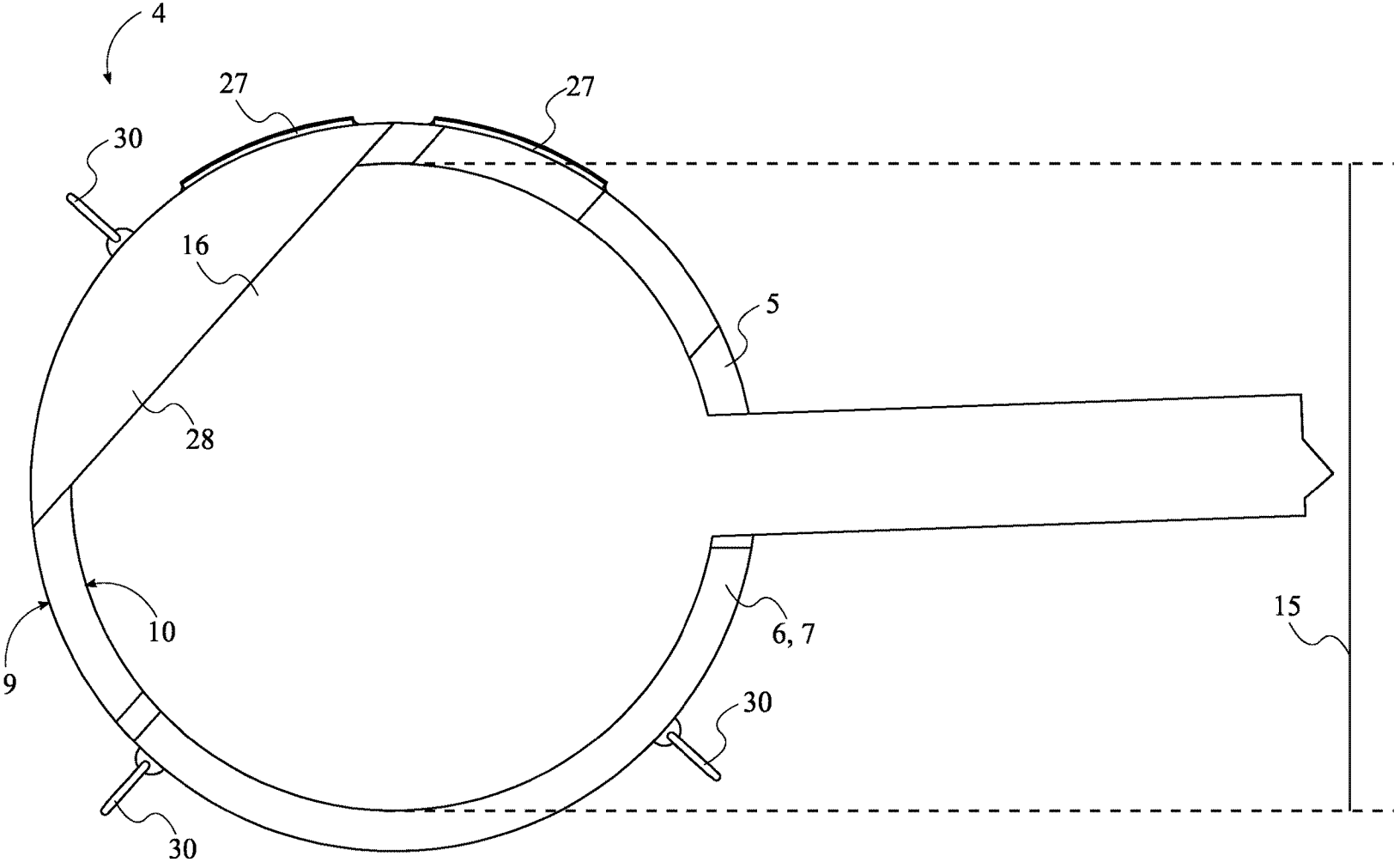
FIG. 2 is a front view of the present invention, wherein the present invention is shown attached to a banjo acoustic chamber.

In some embodiments, the present invention may also include storage compartments on the outside of the annular padded rim 4 to keep different objects readily accessible when the present invention is attached to the banjo acoustic chamber 16. So, the present invention may further comprise at least one supplemental pocket 27, as can be seen in FIGS. 1, 2, and 4. Like the at least one secondary distal pocket 22, the at least one supplemental pocket 27 is preferably designed to receive small objects, such as keys. The at least one supplemental pocket 27 is mounted onto the outer annular surface 9 to keep the objects accessible when the present invention is attached to the banjo acoustic chamber 16. In addition, to make the at least one supplemental pocket 27 accessible while the banjo is being played, the at least one supplemental pocket 27 is positioned in between the 90-degree axis 12 and the 270-degree axis 14, opposite to the neck-receiving cutout 5. This enables the user to easily reach into the at least one supplemental pocket 27 while playing the banjo. In other embodiments, the at least one supplemental pocket 27 can include multiple supplemental pockets distributed along the outer annular surface to store multiple objects.

To make the playing of the banjo as comfortable as possible while using the present invention, the present invention may further comprise a padded armrest 28. As can be seen in FIGS. 1 through 4, the padded armrest 28 provides a cushioning surface onto which the player can rest their arm while playing the banjo. The padded armrest 28 is positioned offset from the neck-receiving cutout 5 about the rim body 6 to match the natural positioning of the player's arm. Further, the padded armrest 28 is mounted onto the outer annular surface 9. This enables the padded armrest 28 to also serve as a locking means to secure the present invention to the banjo acoustic chamber 16. In some embodiment, the padded armrest 28 is designed to fit on top of an armrest provided on most banjos. The neck-receiving cutout 5 is positioned coincident with the 0-degree axis 11. Further, the padded armrest 28 is positioned in between the 90-degree axis 12 and the 180-degree axis 13. This arrangement of the neck-receiving cutout 5 and the padded armrest 28 is design to match the location of the banjo's armrest relative to the position of the banjo's neck. In other embodiments, additional padding can be provided in other locations around the annular padded rim 4.

Furthermore, to enable the attachment of different accessories such as a shoulder strap to the present invention, the present invention may further comprise at least one attachment ring 30. As can be seen in FIGS. 1 through 4, the at least one attachment ring 30 enables the attachment of accessories to the present invention using common fasteners such as a carabiner or a hook. The at least one attachment ring 30 is mounted onto the outer annular surface 9 so that the accessory can be attached from the outside of the annular padded rim 4. Further, the at least one attachment ring 30 can be positioned in multiple locations along the outer annular surface 9 to hold the attachments in different locations around the present invention. In other embodiments, multiple attachment rings can be distributed about the outer annular surface 9 so that an accessory such as a shoulder strap can be completely attached to the present invention using multiple attachment rings.

In addition to the padding of the present invention, the present invention may further comprise a fluff lining 29 to protect the outer surfaces of the banjo acoustic chamber 16. As can be seen in FIG. 5, the fluff lining 29 is mounted across the inner annular surface 10 and the distal backing face 2. The fluff lining 29 can be made of different materials such as velvet or silk which is soft enough to protect the delicate surfaces of the banjo acoustic chamber 16. This way the fluff lining 29 fully encloses the banjo acoustic chamber 16 when the present invention is attached to the banjo acoustic chamber 16. In other embodiments, additional protective layers can be provided to further protect the banjo acoustic chamber 16.

Although the invention has been explained in relation to its preferred embodiment, it is to be understood that many other possible modifications and variations can be made without departing from the spirit and scope of the invention as hereinafter claimed.

What is claimed is:

1. A banjo acoustic-chamber cushion comprising:
- a circular padded backing;
- an annular padded rim;
- the circular padded backing comprising a distal backing face and a proximal backing face;
- the annular padded rim comprising a neck-receiving cutout and a rim body;
- the rim body comprising a distal rim face, a proximal rim face, an outer annular surface, and an inner annular surface;
- a 0-degree axis, a 90-degree axis, a 180-degree axis, and a 270-degree axis being radially positioned to the annular padded rim;
- the annular padded rim being positioned concentric to the circular padded backing;
- the proximal rim face being connected onto the distal backing face;
- the neck-receiving cutout traversing into the rim body from the distal rim face;
- the neck-receiving cutout traversing through the rim body from the outer annular surface to the inner annular surface; and,
- a diameter of the inner annular surface being sized to compressively fit around a banjo acoustic chamber.

2. The banjo acoustic-chamber cushion as claimed in claim 1, wherein the circular padded backing and the annular padded rim are made of a shared cushioning material and a shared covering material, and wherein the shared cushioning material is enclosed by the shared covering material.

3. The banjo acoustic-chamber cushion as claimed in claim 2, wherein the shared cushioning material is selected from a group consisting of: a polyurethane foam and a cellulose-based material.

4. The banjo acoustic-chamber cushion as claimed in claim 2, wherein the shared covering material is selected from a group consisting of: vinyl and nylon.

5. The banjo acoustic-chamber cushion as claimed in claim 1 comprising:
- at least one primary distal pocket; and,
- the at least one primary distal pocket being mounted onto the distal backing face.

6. The banjo acoustic-chamber cushion as claimed in claim 5 comprising:
- the at least one primary distal pocket comprising a primary distal concave edge and a primary distal straight edge;
- the primary distal concave edge being peripherally connected about the distal backing face; and, the primary distal concave edge intersecting the 0-degree axis, the 270-degree axis, and the 180-degree axis.

7. The banjo acoustic-chamber cushion as claimed in claim 5, wherein the at least one primary distal pocket is made of an elastic fabric material.

8. The banjo acoustic-chamber cushion as claimed in claim 5 comprising:

at least one secondary distal pocket;

the at least one secondary distal pocket being mounted onto the distal backing face; and, the at least one secondary distal pocket being positioned offset from the at least one primary distal pocket.

9. The banjo acoustic-chamber cushion as claimed in claim 8, wherein the at least one secondary distal pocket is made of an elastic fabric material.

10. The banjo acoustic-chamber cushion as claimed in claim 1 comprising:

at least one primary proximal pocket; and, the at least one primary proximal pocket being mounted onto the proximal backing face.

11. The banjo acoustic-chamber cushion as claimed in claim 10 comprising:

the at least one primary proximal pocket comprising a primary proximal concave edge and a primary proximal straight edge;

the primary proximal concave edge being peripherally connected about the proximal backing face; and, the primary proximal concave edge further intersecting the 0-degree axis, the 270-degree axis, and the 180-degree axis.

12. The banjo acoustic-chamber cushion as claimed in claim 10, wherein the at least one primary proximal pocket is made of an elastic fabric material.

13. The banjo acoustic-chamber cushion as claimed in claim 10 comprising:

at least one secondary proximal pocket;

the at least one secondary proximal pocket being mounted onto the proximal backing face; and, the at least one secondary proximal pocket being positioned offset from the at least one primary proximal pocket.

14. The banjo acoustic-chamber cushion as claimed in claim 13, wherein the at least one secondary proximal pocket is made of an elastic fabric material.

15. The banjo acoustic-chamber cushion as claimed in claim 1 comprising:

at least one supplemental pocket; and, the at least one supplemental pocket being mounted onto the outer annular surface.

16. The banjo acoustic-chamber cushion as claimed in claim 15 comprising:

the at least one supplemental pocket being positioned in between the 90-degree axis and the 270-degree axis, opposite to the neck-receiving cutout.

17. The banjo acoustic-chamber cushion as claimed in claim 1 comprising:

a padded armrest;

the padded armrest being positioned offset from the neck-receiving cutout about the rim body; and, the padded armrest being mounted onto the outer annular surface.

18. The banjo acoustic-chamber cushion as claimed in claim 17 comprising:

the neck-receiving cutout being positioned coincident with the 0-degree axis; and, the padded armrest being positioned in between the 90-degree axis and the 180-degree axis.

19. The banjo acoustic-chamber cushion as claimed in claim 1 comprising:

at least one attachment ring; and, the at least one attachment ring being mounted onto the outer annular surface.

20. The banjo acoustic-chamber cushion as claimed in claim 1 comprising:

a fluff lining; and, the fluff lining being mounted across the inner annular surface and the distal backing face.

* * * * *